US005284562A

United States Patent [19]

Beck et al.

[11] Patent Number: 5,284,562

[45] Date of Patent: Feb. 8, 1994

[54] NON-CONSUMABLE ANODE AND LINING FOR ALUMINUM ELECTROLYTIC REDUCTION CELL

[75] Inventors: Theodore R. Beck; Richard J. Brooks, both of Seattle, Wash.

[73] Assignees: Electrochemical Technology Corp.; Brooks Rand, Ltd., both of Seattle, Wash.

[21] Appl. No.: 870,672

[22] Filed: Apr. 17, 1992

[51] Int. Cl.[5] ..... C25C 3/08; C25C 3/12

[52] U.S. Cl. ..... 204/243 R; 204/244; 204/245; 204/293; 204/292

[58] Field of Search ..... 204/67, 243 R, 245, 204/292, 293

[56] References Cited

U.S. PATENT DOCUMENTS 4,399,008 8/1983 Ray ..... 204/67
4,529,494 7/1985 Joó et al. ..... 204/292 X
4,620,905 11/1986 Tarcy et al. ..... 204/64 R
4,871,438 10/1989 Marschmann ..... 204/291
4,999,097 3/1991 Sadoway ..... 204/243 R
5,006,209 4/1991 Beck et al. ..... 204/291 X
5,069,771 12/1991 Nguyen et al. ..... 204/292

*Primary Examiner*—Donald R. Valentine
*Attorney, Agent, or Firm*—Marshall, O'Toole, Gerstein, Murray & Borun

[57] ABSTRACT

An oxidation resistant, non-consumable anode, for use in the electrolytic reduction of alumina to aluminum, has a composition comprising copper, nickel and iron. The anode is part of an electrolytic reduction cell comprising a vessel having an interior lined with metal which has the same composition as the anode. The electrolyte is preferably composed of a eutectic of $AlF_3$ and either (a) NaF or (b) primarily NaF with some of the NaF replaced by an equivalent molar amount of KF or KF and LiF.

31 Claims, 4 Drawing Sheets

NON-CONSUMABLE ANODE AND LINING FOR ALUMINUM ELECTROLYTIC REDUCTION CELL

BACKGROUND OF THE INVENTION

The subject matter described herein is related in a general sense to that described in Beck, et al. U.S. Pat. No. 5,006,209 ('209) issued Apr. 9, 1991 and entitled "ELECTROLYTIC REDUCTION OF ALUMINA", and the disclosure thereof is incorporated herein by reference.

The invention embodied in the subject matter described herein was made during work financed by the following government contracts: NSF Phase I SBIR ISI 8851484; NSF Phase II SBIR ISI-8920676; and DOE Contract DE-FG01-89CE15433.

The present invention relates generally to the electrolytic reduction of alumina to aluminum and more particularly to an anode and to a lining for the cell used in the electrolytic reduction process.

The aforementioned Beck, et al. '209 patent is directed to a method and apparatus for the electrolytic reduction of alumina to aluminum. The electrolytic reduction is performed in an electrolytic reduction vessel having a plurality of vertically disposed, non-consumable anodes and a plurality of vertically disposed, dimensionally stable cathodes in closely spaced, alternating arrangement with the anodes. The vessel contains a molten electrolyte bath composed of (1) $NaF+AlF_3$ eutectic, (2) $KF+AlF_3$ eutectic and (3) LiF. In one embodiment, a horizontally disposed, gas bubble generator is located at the vessel bottom, underlying the cathodes and the spaces between each pair of adjacent electrodes.

Finely divided particles of alumina are introduced into the bath where they are maintained in suspension in the molten electrolyte by rising gas bubbles generated at the anodes and at the gas bubble generator, during the electrolytic reduction process. The horizontally disposed, gas bubble generator may be an auxiliary anode or anode part located at substantially the bottom of the electrolytic reduction vessel, in contact with the molten electrolyte bath, or it may be in the form of a gas sparger for bubbling air or nitrogen upwardly from the vessel bottom.

The molten electrolyte bath has a density less than the density of molten aluminum and less than the density of alumina. Metallic aluminum forms at each of the cathodes, during performance of the electrolytic reduction process, and the metallic aluminum flows downwardly as molten aluminum along each cathode toward the bottom of the vessel where the molten aluminum accumulates. The molten electrolyte bath is maintained at a relatively low temperature in the range of about 660° C. to about 800° C. (1220°-1472° F.). The molten electrolyte has a composition which provides a relatively low anode resistance, avoids excessive corrosion of the anode and avoids deposition of bath components on the cathodes.

The anodes disclosed in the aforementioned Beck, et al. '209 patent are composed of copper or of nickel ferrite-copper cermet. The electrolyte bath disclosed in the Beck, et al. '209 patent produced reduced corrosion on copper anodes, compared to the corrosion produced by other electrolyte bath compositions. However, the corrosion rate for the copper anodes was still subject to improvement.

Attempts have also been made to employ, as a non-consumable anode composition, a nickel ferrite-copper cermet In this connection, see U.S. Pat. Nos. 4,399,008 and 4,620,905, for example. However, a nickel ferrite-copper cermet anode has also proved to have significant drawbacks, and it has not proven to be feasible for the electrolytic reduction of alumina to aluminum on a commercial scale. U.S. Pat. No. 4,999,097 discloses an electrolyte cell for the electrolytic reduction of alumina to aluminum, and this cell employs an anode composed of a foundation metal which can be, among others, copper, nickel, steel or combinations thereof.

The cell employed in conventional processes for the electrolytic reduction of alumina to aluminum comprises a vessel for containing a molten electrolyte usually composed of halides. The vessel has an external shell and has an interior lined with various materials. The bottom of the vessel has a layer of refractory material, e.g. alumina, adjacent the external shell, and the interior is lined at the bottom with carbon or graphite blocks. The walls of the cell also are lined with carbon or graphite blocks, but unlike the bottom, the walls are not insulated with a refractory material.

The seams between the blocks are filled with carbon paste. During operation of the cell, the molten electrolyte penetrates into any unfilled seams or voids or cracks in the interior lining. Penetration of the electrolyte into the lining causes the lining to deteriorate. Penetration occurs up to a level called the freeze line, which is the level on the uninsulated walls where enough heat is lost from the molten electrolyte to cause it to freeze. Generally, there is a frozen ledge at this level and above, composed of solidified electrolyte and alumina.

After 1,000 to 3,000 hours of operation, the interior lining of the vessel deteriorates to the point where it must be replaced. Disposal of spent lining removed from the vessel is a problem, with piles of spent lining accumulating around aluminum reduction plants.

In a cell of the type disclosed in the aforementioned Beck, et al. '209 patent, an excess of alumina is introduced into the molten electrolyte, and the resulting bath composition allows the use of alumina refractory brick to line the interior walls of the vessel. Because the walls are thus thermally insulated, the frozen ledge is eliminated, which is desirable. However, the alumina bricks which line the walls on the interior of the vessel are subject to the same penetration problems as carbon blocks, even though the alumina blocks will last longer.

It would be desirable to have an interior lining for the vessel which is not subject to electrolyte penetration, which is easy to replace, which can be readily recycled and which allows the entire vessel to be thermally insulated.

SUMMARY OF THE INVENTION

The present invention relates to a composition for a non-consumable anode to be used in conjunction with an electrolytic reduction cell, preferably a cell of the type described herein. An anode having a composition in accordance with the present invention, when used in conjunction with the electrolytic reduction cell described herein, at the very least retains all the features and advantages enjoyed as a result of employing the cell and electrolyte bath composition of the Beck, et al. '209 patent. In addition, the anode has improved resistance to corrosion by oxidation in the molten electrolyte bath, compared to other anode compositions in the same bath.

More particularly, the present invention provides a corrosion-resistant, non-consumable anode having a composition consisting essentially of, in wt.%, about 25–70 copper, about 15–60 nickel and about 1–30 iron. Preferably, the anode composition consists essentially of, in wt.%, about 45–70 copper, about 25–48 nickel and about 2–17 iron. Most preferably the anode composition consists essentially of, in wt.%, about 45–70 copper, about 28–42 nickel and about 13–17 iron.

Another feature of the present invention is a cell vessel interior lining which is impervious to penetration by molten electrolyte, which can be readily replaced and which may be readily recycled. The lining covers the bottom and walls of the vessel interior and is composed of metal having the same composition as the anode composition described in the preceding paragraph. Located between the external shell and the interior metal lining of the vessel is refractory material, such as alumina or insulating fire brick, which thermally insulates the bottom and walls of the vessel. The interior metal lining is electrically connected to the anodes, and the lining then constitutes part of the anode arrangement. During operation of the cell, oxygen bubbles are generated at the bottom and elsewhere on the interior metal lining when the latter is part of the anode arrangement, and these bubbles help to maintain in suspension in the molten electrolyte the finely divided alumina particles introduced into the cell.

The anodes of the present invention may be fabricated from sintered metal powders to produce an anode having a porous surface and a density substantially less than the theoretical density for a given composition (e.g. 60–70% of theoretical density). These less dense anodes have a resistance to corrosion by oxidation, when immersed in the cell's electrolyte, which is greater than that of anodes having a substantially higher density, e.g. above 90% of theoretical density; this effect is probably due to a lower actual current density at the surface of the less dense anodes. However, the denser anodes have a greater resistance to oxidation in air.

Preferably, a cell in accordance with the present invention employs, as an electrolyte, a eutectic or near-eutectic composition consisting essentially of 42–46 mol% $AlF_3$ (preferably 43–45 mol% $AlF_3$) and 54–58 mol% of either (a) all NaF or (b) primarily NaF with equivalent molar amounts of KF or KF plus LiF replacing some of the NaF.

Other features and advantages are inherent in the subject matter claimed and disclosed or will become apparent to those skilled in the art from the following detailed description in conjunction with the accompanying diagrammatic drawings.

DETAILED DESCRIPTION

Figure 1:
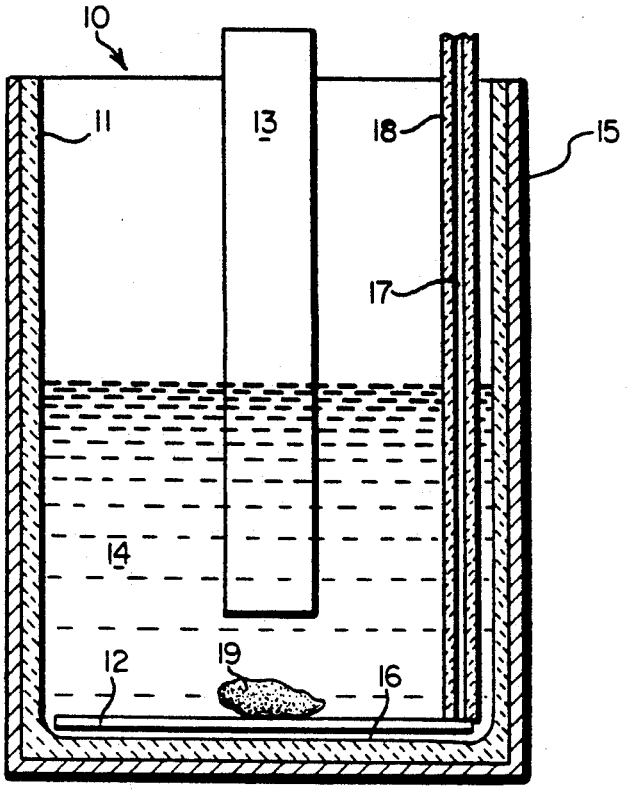
FIG. 1 is a vertical sectional view of a test cell employed for determining the corrosion-resistance of a non-consumable anode having a composition in accordance with present invention.

Anode oxidation tests of various alloys were performed in a test apparatus or cell indicated generally at 10 in FIG. 1. Apparatus 10 is a laboratory cell comprising a fused alumina crucible 11 having a volume of 500 $cm^3$ and containing an anode 12, a cathode 13, and a molten electrolyte bath 14. Alumina crucible 11 is positioned within a stainless steel retaining can 15. Cathode 13 is a 4 mm-thick slab of $TiB_2$ with an immersed area of about 20 $cm^2$ or a $TiB_2$ rod having a diameter of 23 mm and a length of 100 mm with an immersed area of 23 $cm^2$. Anode 12 is in the form of a metal disc overlying and substantially covering the bottom 16 of crucible 11. A vertical copper conductor 17 has a lower end connected to disc 12 and an upper end connected to a source of electric current (not shown). Vertical conductor 17 is insulated with an alumina tube 18 so as to confine the anodic current to test disc 12.

The apparatus of FIG. 1 was placed in a furnace and held at a temperature of about 750° C. The temperature of bath 14 was measured continuously with a chrome[1]-alumel thermocouple contained in a closed-end, fused alumina tube.

The electrolyte composition generally consisted essentially of, in parts by weight, 66 $AlF_3$, 26 NaF, 8 KF, and 3–4 LiF. Corresponding mol percents are 46.7 $AlF_3$, 36.7 NaF, 8.3 KF and about 8.3 LiF. About 10 parts by weight of alumina, having a mean particle size of about two to ten microns, were added to the electrolyte bath. The total bath weight, including added alumina particles, was about 350 grams.

When current of about 20 amperes was supplied, aluminum metal was produced at cathode 13 by electrolysis. Molten aluminum dripped off of cathode 13 and formed an irregularly shaped ball 19 which rested on anode 12 and was levitated by oxygen bubbles issuing from anode 12. There was no evidence of reaction of anode 12 with the metal of ball 19.

Test runs were performed typically for 6–7 hours.

A more detailed description of an electrolytic reduction process of the type involved in these tests is contained in the aforementioned Beck, et al. '209 patent.

The anodes were composed of various commercial alloys and special alloys prepared for testing. Using a sintering procedure, copper-nickel iron anodes were made by premixing metal powders in the desired ratio and then heating, in a boron nitride-coated graphite die, to 1180° C. in an argon atmosphere for at least one hour. The powders had a particulate size of 4 to 60 microns, but particle size is not important if the alloy is melted. Pressure may or may not be applied to assure gas displacement from the powder mixture and to increase density. Depending upon the melting temperature of the composition, a temperature of 1180° C. will either sinter the powder mixture to form a disc or cause the powder mixture to melt into a disc.

It had previously been determined that several cycles of (a) current-on (e.g. for 2–5 minutes) followed by (b) current-off (e.g. at least one minute), at the beginning of a run, gave lower cell voltage and a lower rate of anode oxidation, compared to runs without such an on-off procedure. In this connection, see the Beck et al. '209 patent at col. 11, line 65 to col. 12, line 5. When testing the anodes here, this on-off procedure was utilized on some of the test runs employing the electrolyte described above.

At the end of each test run, there was oxide adhering to the anode, reflecting oxidation during the test run. This oxide was hammered off the anode, and the resulting anode weight loss was determined. The weight loss is expressed as an oxidation rate: $g/cm^2$ h or $mg/cm^2$ h.

Tabulated below are the results of the anode oxidation tests on anodes produced by the sintering procedure. Some of the anode compositions were tested more than once, and in such instances the oxidation weight loss indicated in the table is the average for those tests. In all instances, the numbers have been rounded off to the nearest whole number. An anode composed of 100% copper was used as a comparison base. As noted above, the bath employed in the tests which produced the results tabulated below contained a LiF addition of 3–4 wt.%. A bath with a LiF addition substantially higher than 4 wt.% will produce increased corrosion weight loss.

| Anode Composition Wt. % | Oxidation Weight Loss $mg/cm^2$ h |
|---|---|
| Cu 100 | 20–40 |
| Cu 90: Ni 2.5:Fe 7.5 | 40 |
| Cu 90: Ni 5.0:Fe 5.0 | 39 |
| Cu 90: Ni 7.5:Fe 2.5 | 40 |
| Cu 80: Ni 5.0:Fe 15.0 | 83 |
| Cu 80: Ni 10:Fe 10 | 11 |
| Cu 80: Ni 15:Fe 5 | 6 |
| Cu 80: Ni 20 | 14 |
| Cu 70: Ni 7.5:Fe 12.5 | 97 |
| Cu 70: Ni 15:Fe 15 | 3 |
| Cu 70: Ni 22.5:Fe 7.5 | 8 |
| Cu 60: Ni 10:Fe 30 | 77 |
| Cu 60: Ni 20:Fe 20 | 3 |
| Cu 60: Ni 30:Fe 10 | 1 |
| Cu 60: Ni 35:Fe 5 | 1 |
| Cu 60: Ni 40 | 9 |
| Cu 50: Ni 25:Fe 25 | 3 |
| Cu 50: Ni 37.5:Fe 12.5 | 1 |
| Cu 50: Ni 45:Fe 5 | 1 |
| Cu 50: Ni 50 | 5 |
| Cu 40: Ni 25:Fe 35 | 12 |
| Cu 40: Ni 35:Fe 25 | 13 |
| Cu 40: Ni 45:Fe 15 | 3 |
| Cu 40: Ni 55:Fe 5 | 4 |
| Cu 30: Ni 35:Fe 35 | 12 |
| Cu 30: Ni 52.5:Fe 17.5 | 4 |

Figure 3:
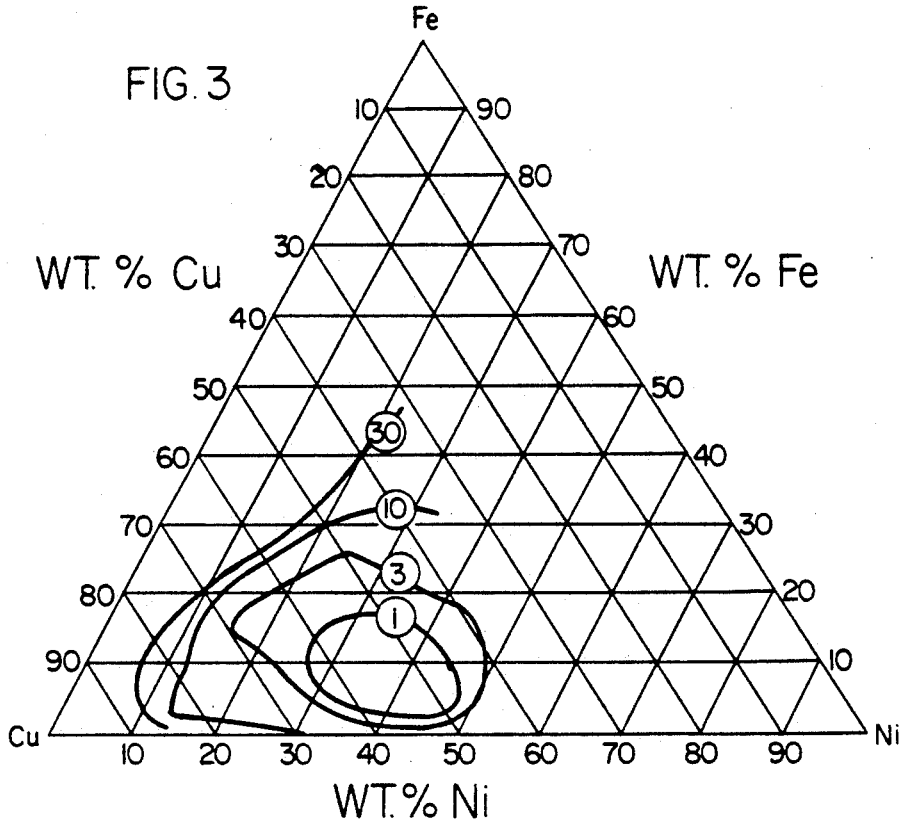
FIG. 3 is a triangular compositional diagram for copper-nickel-iron, showing isooxidation lines, for sinter anodes.

FIG. 3 was obtained by cross plotting, on the Cu-Ni-Fe composition diagram, the results tabulated above. The figure shows isooxidation lines, and the numbers on the isooxidation lines are $mg/cm^2$ h. As reflected by FIG. 3, the center of the area of minimum corrosion weight loss occurs at an anode having a composition of, in wt.%, about Cu 55:Ni 35:Fe 10.

Figure 4:
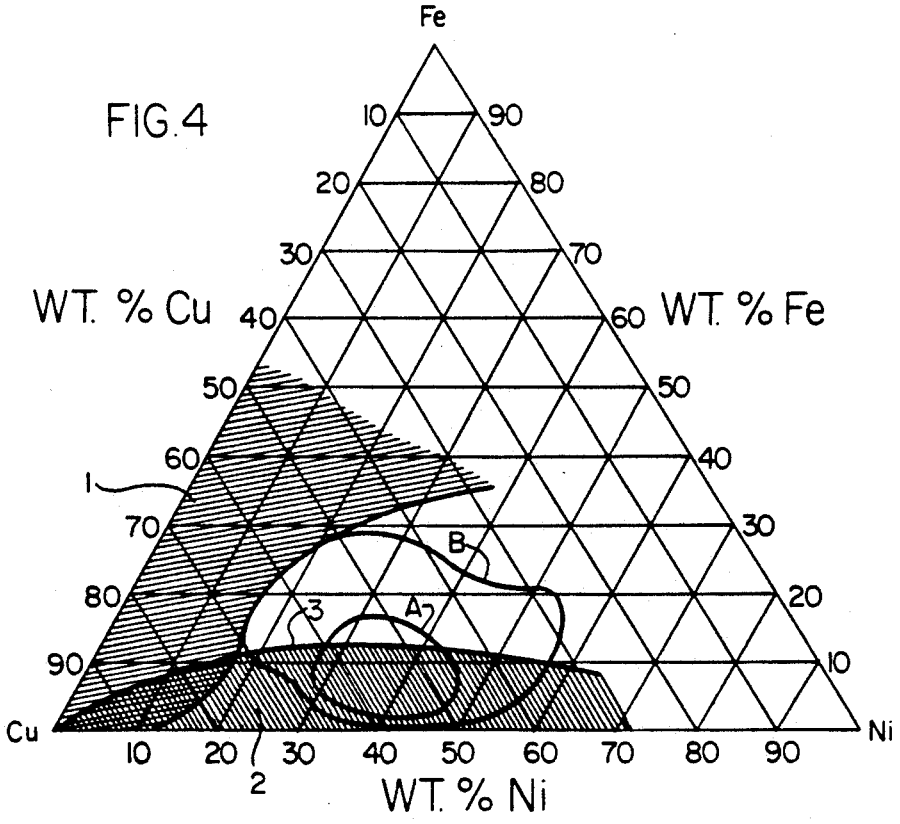
FIG. 4 is a triangular compositional diagram for copper-nickel-iron, showing isooxidation lines, a region of blister corrosion and a region of high electrical resistance, for sintered anodes.

FIG. 4 shows some regions of alloy composition which produce undesirable results other than mere oxidation. The low-nickel alloys in region 1 suffer a catastrophic blister corrosion producing blisters of metal oxide filled with a mixture of metal oxide and electrolyte. The low-iron alloys in region 2 produce a high-resistance, oxide surface layer on the anode. The high-resistance of alloys in region 2 in FIG. 4 may exclude alloys in that region from use with the rest of the low oxidation-rate alloys reflected by FIG. 3 and FIG. 4, or one may be required to operate at a lower actual current density for an anode composed of a low-oxidation rate alloy in region 2.

Some uncertainty in the oxidation rate occurs for alloys with less than 50% copper because of increasing porosity observed in the test anodes sintered at 1180° C. At 50% copper, the density was about 60% of theoretical, and at 40% copper the density was about 50% of theoretical. Low density means high porosity. Nevertheless, despite the high porosity of the sintered 40–50% copper test anodes, oxidation was limited to the anode surface because the electrolyte bath penetrated the anode and filled the pores. In contrast, oxidation rates for the same porous test pieces tested in air at similar temperatures, without employing a bath, were extremely high because of internal oxidation.

Further tests were conducted with the apparatus of FIG. 1, under conditions similar to those used in the initial tests described above, but employing a different electrolyte. The anode in these further tests had a composition consisting essentially of, in wt.%, Cu 50: Ni 37.5: Fe 12.5. In one test, the electrolyte consisted essentially of a eutectic composition of 44 mol% $AlF_3$ (61.1 wt.%) and 56 mol% NaF (38.9 wt.%), and the oxidation weight loss of the anode was 3 $mg/cm^2$ h. In two other tests, the electrolyte consisted essentially of a near-eutectic composition of 45 mol% $AlF_3$ (62.1 wt.%) and 55 mol% NaF (37.9 wt.%), and the oxidation weight loss was 2 $mg/cm^2$ h and 3 $mg/cm^2$ h, respectively. An advantage of employing the two electrolytes used in these further tests is that it was unnecessary to use the on-off start-up procedure required when using the electrolyte employed in the earlier tests described above.

In another series of tests, conducted without electrolyte, high-density, alloy buttons or discs having compositions covering essentially the whole Cu:Ni:Fe diagram were prepared by melting the alloys at about 1400° C. in an induction furnace and then solidifying the molten alloys into buttons. The alloys were melted in graphite crucibles, some internally uncoated and some internally coated with boron nitride. The button dimensions were about 12 mm in diameter and about 7 mm thick. Densities of the buttons were greater than 95% of theoretical. Air oxidation tests (without employing a bath) were performed by subjecting the buttons to a temperature of 800° C. for a period typically in the range 8 hours to 280 hours. Air oxidation tests of one such button were performed for a period of over 5 months.

Figure 5:
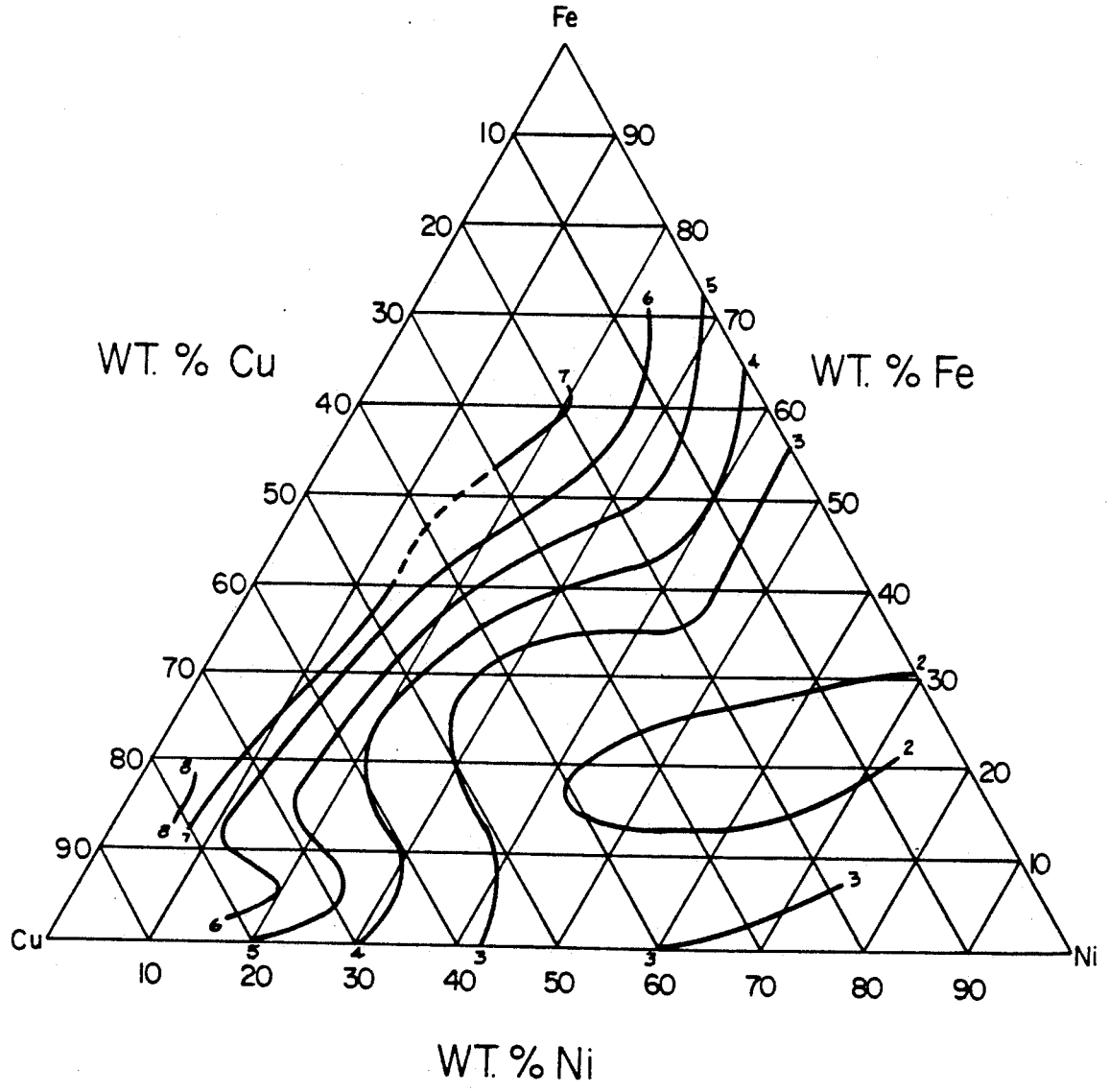
FIG. 5 is a triangular compositional diagram for copper-nickel-iron, showing issoxidation lines arising from oxidation in air, for induction melted anodes.

Weight loss of alloy due to oxidation in air was measured and converted to equivalent weight loss for a time period of 7 hours, to properly compare with the data for anode weight loss in electrolyte reflected in FIG. 3. Isooxidation lines derived from this test are shown in FIG. 5. The region of low oxidation rate in FIG. 5 is generally similar to that shown in FIG. 3, but the region extends further to lower copper concentrations. The lowest oxidation rates are along a line that is approximately three parts nickel to one part iron, which is generally consistent with FIG. 3. In the low nickel region, the air oxidation rates shown in FIG. 5 are not as high as the oxidation rates shown in FIGS. 3 and 4 which reflect the oxidation of anodes in electrolyte, producing blister corrosion in the low nickel region (region 1 in FIG. 4).

On the basis of the foregoing considerations, a desirable anode composition, resistant to oxidation weight loss, comprises, in wt.%, about:

| | |
|---|---|
| Cu | 25–70 |
| Ni | 15–60 |
| Fe | 1–30 |

This composition is located within the area defined by isooxidation ring B in FIG. 4 and has an oxidation weight loss no greater than about 5 mg/cm$^2$ h after 6–7 hours.

For a given Cu content in the range 25–70 wt.%, an alloy also having about three parts of Ni to one part Fe generally appears to produce better oxidation resistance than an alloy having other ratios of Ni and Fe (FIG. 5).

Preferably, the proportions for the anode composition are, in wt.%, about:

| | |
|---|---|
| Cu | 45–70 |
| Ni | 25–48 |
| Iron | 2–17 |

This composition is located mostly within the area defined by isooxidation ring A in FIG. 4 which has an oxidation weight loss no greater than about 1 mg/cm$^2$ h.

Most preferably, the proportions for the anode composition are, in wt.%, about:

| | |
|---|---|
| Cu | 45–70 |
| Ni | 28–42 |
| Fe | 13–17 |

This composition is mostly within that part of ring A, in FIG. 4, which excludes higher resistance area 2.

In addition to the anode compositions tabulated above, other compositions were tested, but the oxidation weight loss for each of these other compositions was extremely high, in comparison, and rendered these other compositions unusable. These other compositions include 304 stainless steel, 93 Cu:7 Al aluminum bronze and Hastelloy X (22 Cr:9 Mo:20 Fe:0.15 C:bal. Ni).

In the oxidation tests in electrolyte, it was found that the thickness of the alloy layer which oxidized after 6–7 hour runs, and which was removed from the metal anodes as oxide, was in general agreement with the weight loss of the anode after removal of the oxide. This finding indicates that there was no significant dissolution of oxide from the anode into the bath in a 6 to 7 hour test run, and therefore dissolution of oxide is not a significant factor in determining oxidation rate by measuring weight loss after a seven hour run.

With respect to metal buttons having compositions in the above-described, desirable weight proportion of Cu 25–70:Ni 15–60:Fe 1–30, it was determined that the weight loss of such a button due to oxidation in air at 800° C. for 6–7 hours, was comparable to the oxidation weight loss of the above-described anode due to oxidation in the above-described electrolyte bath at a temperature of 750° C. for 6–7 hours, namely a weight loss of not substantially greater than about 5 mg/cm$^2$ h, or less. For other compositions, having low nickel contents and exhibiting blister corrosion (region 1 in FIG. 4), there was no such correlation between oxidation weight loss in the electrolyte bath and in air. However, as to compositions of the type described two sentences above, because of the aforementioned correlation it is possible to obtain a reasonable approximation of the oxidation weight loss over an extended period (e.g. months), due to oxidation in the electrolyte bath, by determining the weight loss, for such a period, due to oxidation in air.

More particularly, air oxidation tests were performed, over various time periods, on buttons having a 70 Cu:15 Ni:15 Fe composition. One such test was conducted for over five months on a button forced by melting. These tests produced data which, when plotted as oxidation weight loss versus the square root of time, produced a substantially straight line for times greater than about one day, from which one could extrapolate oxidation weight loss for a year.

For a densified composition which was obtained by melting (95% of theoretical density), the air oxidation loss for one year, by extrapolation, would correspond to the amount of oxide produced by the corrosion of a metal layer 1 mm thick, and this is an acceptable amount. For a less dense composition (91% of theoretical density), air oxidation tests were conducted over a time period of about one week, and the air oxidation loss was substantially greater, by a factor of ten, than that of the densified composition. The increased oxidation in air of the less dense composition is attributed to internal oxidation. This emphasizes the importance of providing a densified composition when the anode is composed of a mixture of metal powders and a high resistance to oxidation in air is the desired characteristic. The desired high densification may be obtained either by melting the powders or, when sintering, by applying to the powders pressure sufficient to produce a density corresponding substantially to that obtained by melting. As stated earlier, though, bath penetration protects porous anodes against oxidation in the electrolyte bath.

Although the oxidation loss for one year, extrapolated from the air oxidation data described above, constitutes the oxide corroded from a metal layer 1 mm thick, other data suggest that oxidation loss in an electrolyte bath could be substantially less, e.g. the oxide corroded from a metal layer about 0.3 mm thick. More particularly, the extrapolation producing the one year oxidation loss of 1 mm of metal was based on air oxidation data from tests conducted over a period of time in excess of five months, on dense buttons having a density of at least 95% of theoretical density. Tests conducted on anodes of the same composition and density, in an electrolyte bath for seven hours, produced only about one-third the oxidation loss produced by tests conducted in air for the same time period. If the same differential occurs at longer time periods, from one day to in excess of one week, an extrapolation of the date which would be produced by tests in the electrolyte bath for that period would indicate a one year loss of about 0.3 mm of metal.

It is expected that the oxide forming on the anode will dissolve in the electrolyte bath at a certain rate and maintain a steady state thickness and oxidation rate after a certain period to time. Since the thickness, on the anodes, of the metal layers which underwent oxidation, agreed with the weight loss for the anodes at a time of 6–7 hours, the dissolution rate of the oxide is assumed to be less than 10% of the relevant thickness at that time. The dissolution rate would then be equal to the oxidation rate when the oxidation rate is ten times smaller than at 6–7 hours. Such a reduced oxidation rate would occur at a time two orders of magnitude longer than 6–7 hours, or about a month.

Calculations indicate that the oxide dissolution rate at one month is only about 0.11% of the aluminum production rate when the nominal anode and cathode current density is 0.5 A/cm$^2$. This gives a projected metal contamination rate of about 0.11% which would be acceptable for commercial practice.

As previously noted, a low density anode having a relatively porous surface is subject to penetration by the electrolyte bath and exhibits lower corrosion due to oxidation, when immersed in the electrolyte, than does a denser anode having a relatively imporous surface. As described above, high density anodes (e.g. 95% of theoretical density) are obtained from molten alloy or by sintering metal powders at relatively high temperatures and pressures. Low density anodes (e.g. 60–70% of theoretically density) are obtained by sintering metal powders at lower temperatures and pressures (which can be determined empirically).

It is believed that the difference in oxidation rates in the electrolyte, between low density and high density anodes, is due to differences between the anode's actual current density and its superficial current density. For a given current (expressed in amperes) and a given rectangular anode, the superficial current density (amps/cm$^2$) on an anode surface is dependent upon the straight line dimensions of the surface, from edge to edge. For a rectangular surface, the superficial surface area equals the straight line length times the straight line width of that surface, and the superficial current density equals the current divided by the superficial area of all anode surfaces. Thus, for an anode having a relatively high density (e.g. greater than 95% of theoretical density) and a relatively non-porous surface, the actual surface area and the superficial surface area are essentially the same, and so are the actual and superficial current densities. However, for an anode having a relatively low density (e.g. 60–70% of theoretical density) and a substantially porous surface with a multitude of depressions, the actual area of an anode surface is substantially greater than its superficial area, and therefore the actual current density for that anode is substantially smaller than its superficial current density. The data suggests that the rate of oxidation and the anode voltage drop decrease with decreasing actual current density.

For a given superficial current density, there is a minimum bath temperature below which anode resistance and voltage increase substantially, due to a type of anode effect which also occurs with graphite anodes in the same bath. Examples thereof are reflected in the following tabulation.

| Current Density, amps/cm$^2$ | Bath Temperature, °C. |
|---|---|
| 0.1 | 690 |
| 0.5 | 715 |
| 1 | 725 |

This increased anode resistance establishes a lower limit on the operating temperature of the bath.

Referring again to FIG. 4, region 2 thereon (the region of high anode resistance) is for low density (i.e. 50 to 90% of theoretical density), sintered anodes immersed in electrolyte. For high density, induction melted anodes immersed in electrolyte, the upper boundary line 3 for region 2 swings upward and to the left of ring A so that all of ring A is within high resistance region 2. A desirable anode composition for a high density anode which has a relatively good resistance to oxidation, and which is outside blister region 1, consists essentially of, in weight percent, copper 60, nickel 25 and iron 15 or copper 65, nickel 20 and iron 15.

The high anode resistance described in the preceding paragraph is attributable to the high resistance of a surface oxide which forms on an anode having a composition in region 2. It is postulated that this high resistance can be overcome by incorporating into the composition a small quantity of another metallic element which will improve the conductivity of the surface oxide which forms on the anode.

The following information relates to the effect of electrolyte composition on anode oxidation rate. In Beck, et al. U.S. Pat. No. 5,006,209 it was shown that an electrolyte consisting essentially of, in parts by weight, 66 $AlF_3$, 26 NaF, 8 KF and 3 LiF provided a relatively low level of corrosion, gave a low anode resistance and did not give cathode deposits for the anodes described therein. The corresponding mol percents for this composition are: 46.7 $AlF_3$, 36.7 NaF, 8.3 KF and about 8.3 LiF. It has now been determined that, for the anode compositions of the present invention, the molar ratio of AlF to NaF is the important criterion. A eutectic of $AlF_3$ and NaF (44 mol% $AlF_3$ and 56 mol% NaF) is the most advantageous electrolyte composition. A range of $AlF_3$ departing slightly from the 44 mol% eutectic amount, i.e. a range of 42–46 mol% $AlF_3$ (preferably 43–45 mol% $AlF_3$), is permissible.

The alkaline fluoride, employed with the $AlF_3$ in the eutectic or near-eutectic compositions described in the preceding two sentences, can be either all NaF or primarily NaF with some of the NaF replaced by an equivalent molar amount of KF or KF plus LiF. In an electrolyte composed of $AlF_3$ in the range 42–46 mol% and NaF in the range 54–58 mol%, the corresponding ranges in wt.% would be 59–63 wt.% $AlF_3$ and 37–41 wt.% NaF. The electrolyte compositions of the Beck, et al. '209 patent which conform to the ranges of mol per cents described above are quite useful in accordance with the present invention. The other electrolyte compositions of the Beck, et al. '209 patent are useful.

Anode oxidation rate tests for Cu 70: Ni 15: Fe 15 and for Cu 50: Ni 37: Fe 13 show that oxidation is minimized when the $AlF_3$ content of the electrolyte is around the eutectic, 44 mol% $AlF_3$, balance alkaline fluorides, as described above. At above about 46 mol% $AlF_3$ the anodes develop high resistance. At below about 42 mol% $AlF_3$ the anodes suffer blister corrosion and there are cathode deposits. The aforementioned on-off procedure is necessary at compositions near 46 mol% $AlF_3$ but is not necessary at 42–45 mol% $AlF_3$.

In Beck, et al. U.S. Pat. No. 5,006,209 it was indicated that $Al_2O_3$ particles having a size in the range 2–10 μm are preferred. It has now been determined that reduction grade $Al_2O_3$, which contains up to about 100 μm particles, works in the cell of FIG. 1 because the 100 μm particles are agglomerates of smaller particles that disintegrate in the electrolyte into smaller particles of the desired size.

Figure 2:
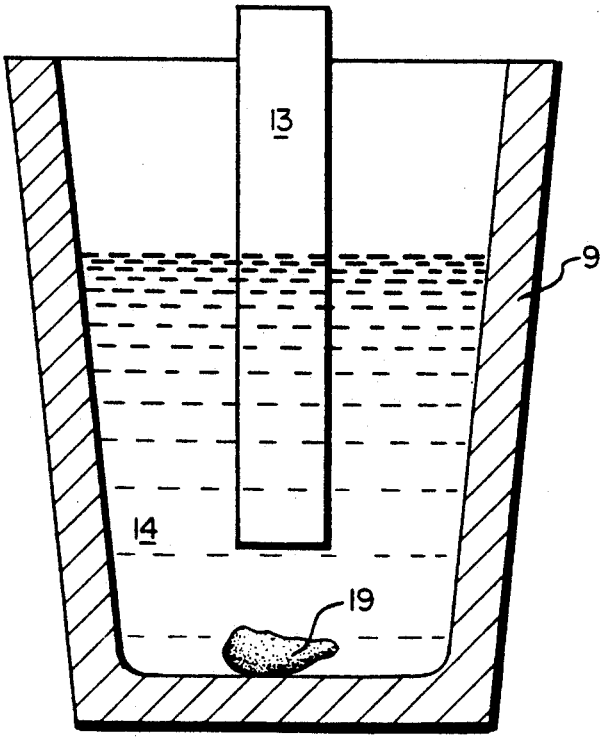
FIG. 2 is a vertical sectional view of a test cell employed for determining the performance of a non-consumable anode lining.

Referring now to FIG. 2, illustrated therein is a test cell comprising a metal crucible 9 containing an electrolyte bath 14 into which extends a cathode 13. The crucible constitutes the anode of the cell and has a composition consisting essentially of, in wt.%, copper 70, nickel 15, iron 15. This corresponds to an anode composition in accordance with the present invention. The crucible was cast from induction melted alloy. The electrolyte composition consists essentially of, in parts by weight, $AlF_3$ 66, NaF 26, KF 8, LiF 4. This is the same electrolyte composition as was used in the initial tests with the cell of FIG. 1, described above. The cell of FIG. 2 was operated at a bath temperature of 755° C. for 5.1 hours, and under those time and temperature conditions, the crucible had an oxidation rate of 6.3 mg/cm$^2$h. The result of the test conducted on the cell of FIG. 2 suggests the usefulness of the alloy composition employed in the present invention not only as a horizontally disposed bottom anode in the cell (FIG. 1), but also as an interior lining for all walls of the cell, vertical as well as horizontal (see FIG. 6).

Figure 6:
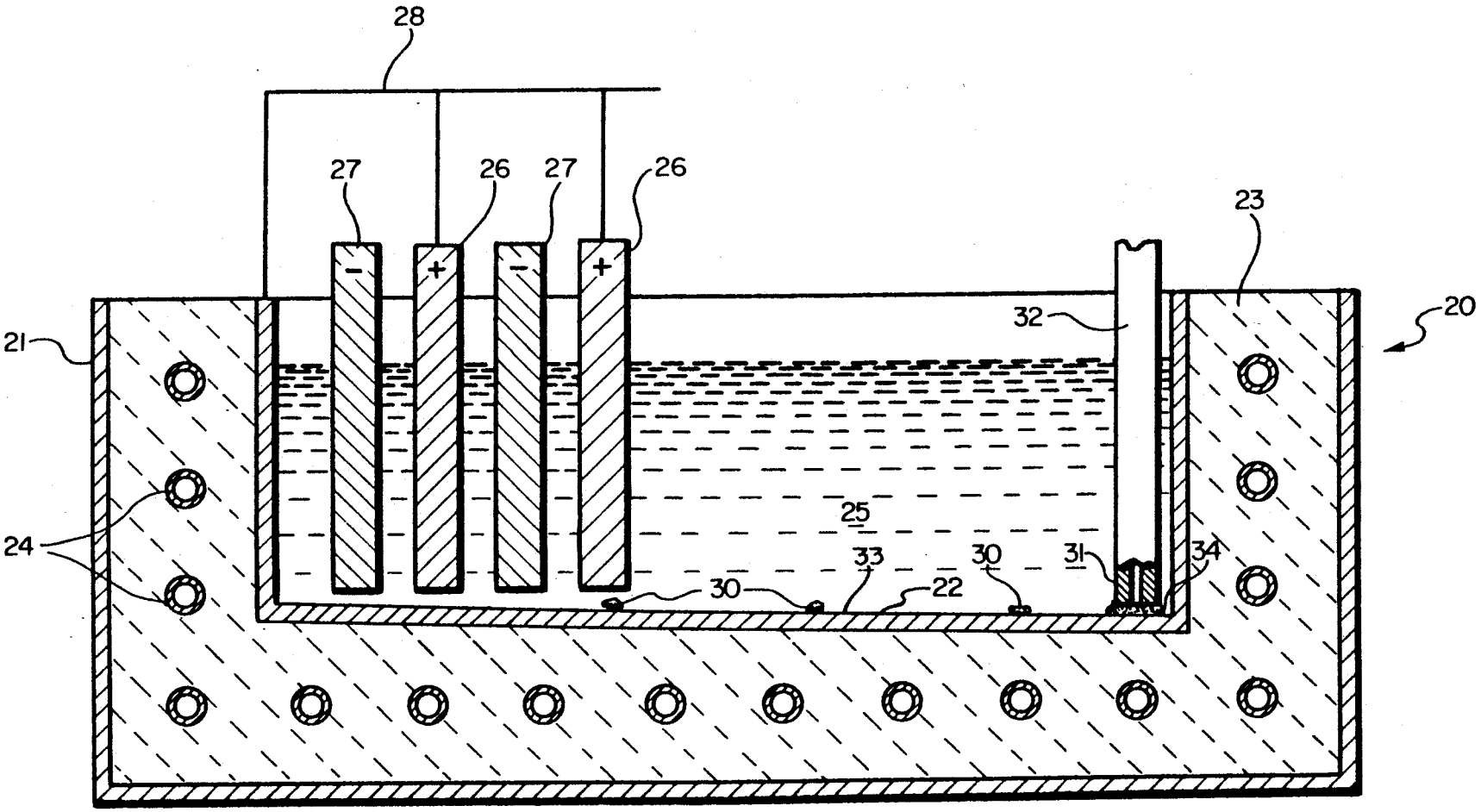
FIG. 6 is a vertical sectional view of an electrolytic reduction cell in accordance with an embodiment of the present invention.

Referring now to FIG. 6, indicated generally at 20 is a vessel for use in the electrolytic reduction of alumina to aluminum. Vessel 20 is constructed in accordance with an embodiment of the present invention and comprises an external shell 21, an interior metal lining 22 and a refractory layer 23 located between external shell 21 and interior metal lining 22. Refractory layer 23 is typically composed of alumina or insulating fire brick. Located within refractory layer 23 are a plurality of conduit portions for circulating a cooling fluid through the refractory layer.

Contained within vessel 20 is a molten electrolyte 25 having a composition typically the same as that described above for use with test cell 10. Preferably, the electrolyte consists essentially of $AlF_3$+NaF eutectic in which $AlF_3$ is present at about 44 mol% but part of the 56 mol% NaF may be replaced by equivalent molar amounts of KF or KF and LiF. An example of an electrolyte which is essentially a eutectic composition, which includes all three alkaline fluorides, and which also conforms to the electrolyte of the Beck, et al. '209 patent, is set forth below:

| Compound | Mol % | Wt. % |
|---|---|---|
| $AlF_3$ | 44.2 | 63.2 |
| NaF | 34.6 | 24.8 |
| KF | 11.6 | 7.7 |
| LiF | 9.6 | 4.3 |

Metal lining 22 in FIG. 6 forms a penetration-proof barrier between the molten electrolyte and refractory layer 23. Vertically disposed within vessel 20 are a plurality of nonconsumable anodes 26 each having an anode composition in accordance with the present invention. Also vertically disposed within vessel 20 are a plurality of dimensionally stable cathodes 27 arranged in close, alternating spaced relation with anodes 26. The cathodes may be composed of titanium diboride.

As shown in FIG. 6, vessel 20 and its principal components, namely, external shell 21, interior metal lining 22 and refractory layer 23 all comprise a bottom and walls extending upwardly from the bottom. Refractory layer 23 thermally insulates the vessel bottom and walls.

Interior metal lining 22 has a composition essentially the same as the composition of anodes 26, and that composition has been discussed in detail above. That part of lining 22 which is exposed to air (i.e. above molten electrolyte 25) has a high density (e.g. 95% or more of theoretical density). Too low a density produces relatively rapid oxidation in air. Induction melting of the alloy from which is produced the exposed part of the lining will give the desired high density.

Vessel 20, anodes 26 and cathodes 27 constitute part of an electrolytic reduction cell. Interior lining 22 is electrically connected to anodes 26 in a conventional manner, and this is indicated schematically at 28 in FIG. 6. The interior metal lining thus constitutes part of the anode arrangement of the cell, and during operation of the cell, fine oxygen bubbles are generated at the bottom and walls of interior lining 22. These bubbles help to maintain in suspension, in the molten electrolyte, the finely divided alumina particles which are introduced into or form within electrolyte 25 in the course of an electrolytic reduction process in accordance with the present invention.

Balls of aluminum 30 form at and drop from cathodes 27 and roll down an inclined vessel bottom 33 to a tap location 34, in this embodiment adjacent one wall of the cell, although it might alternatively be in the middle of the cell bottom, for example. The fine bubbles of oxygen formed on bottom anode lining 22 levitate aluminum balls 30 and facilitate their transport to tap location 34 where the aluminum is removed by a suitable removal device. One embodiment of a removal device is a pierced, titanium diboride member 31 which is wet internally and externally by aluminum and is mounted in the lower, inlet end of a suction tube 32 disposed above tap location 34. Member 31 has a lower-most extremity at tap location 34. A sump (not shown) may be provided at tap location 34 to assist in accumulating molten aluminum there. Titanium diboride member 31 will remove molten aluminum from the cell.

Lining 22 is in the form of sheet material, and it may be relatively thin. In some typical embodiments, lining 22 may have a thickness of about 3.18–9.52 mm ($\frac{1}{8}$–$\frac{3}{8}$ in.).

Because lining 22 is composed of an alloy which is substantially resistant to oxidation losses in the aforementioned molten electrolyte, the lining may be used over a long period of time without the need for replacement. After an extended period of use, lining 22 may be readily removed from within vessel 20 and replaced by a similar lining. Because it is composed of copper base alloy, the spent metal lining, removed from vessel 20, has substantial salvage value as recyclable material. Within proper reconstitution and reworking, the spent lining can be returned to a sheet form for use again as an interior metal lining for vessel 20; or it can be recycled into material useful for other purposes.

The foregoing detailed description has been given for clearness of understanding only, and no unnecessary limitations should be understood therefrom, as modifications will be obvious to those skilled in the art.

We claim:

1. An oxidation-resistant, non-consumable anode for use in an electrolytic reduction cell for aluminum, said anode having a composition throughout the anode consisting essentially of, in wt.%, about:

| | |
|---|---|
| copper | 25–70 |
| nickel | 15–60 |
| iron | 1–30. |

2. A non-consumable anode as recited in claim 1 wherein said composition consists essentially of, in wt.%, about:

| | |
|---|---|
| copper | 45–70 |
| nickel | 25–48 |
| iron | 2–17 |

3. A non-consumable anode as recited in claim 2 wherein said composition consists essentially of, in wt.%, about:

| | |
|---|---|
| copper | 45-70 |
| nickel | 28-42 |
| iron | 13-17 |

4. A non-consumable anode as recited in any of claims 1 to 3 wherein:

the weight ratio of said nickel to said iron is about 3 to 1.

5. A non-consumable anode as recited in any of claims 1 to 3 wherein:

said anode is composed of sintered metal powders and has a porous surface.

6. A non-consumable anode as recited in claim 5 wherein:

said anode has a density substantially less than the theoretical density for said composition.

7. A non-consumable anode as recited in claim 6 wherein:

said anode has a density of about 60-70% of said theoretical density.

8. In combination with the anode of any of claims 1 to 3, a cell for the electrolytic reduction of alumina to aluminum, said cell comprising:

a vessel having a bottom and walls extending upwardly from said bottom;

a plurality of anodes vertically disposed within said vessel, each anode having a composition in accordance with the anode of any of claims 1 to 3;

a plurality of cathodes vertically disposed within said vessel, said cathodes being arranged in close, alternating spaced relation with said vertically disposed anodes;

said vessel having an external shell and an interior metal lining;

a refractory layer located between said external shell and said metal lining for thermally insulating the bottom and walls of said vessel;

said metal lining being electrically connected to said anodes, having essentially the same composition as said anodes and having a relatively high density at that part of the lining which is exposed to air.

9. In the combination of claim 8 wherein:

each anode is composed of sintered metal powders and has a porous surface;

each of said anodes having a density substantially less than the theoretical density for said composition.

10. In the combination of claim 8 wherein:

said cell has a tap location;

said vessel bottom is inclined toward said tap location to accumulate molten aluminum at said tap location;

and said cell comprises a removal means at said tap location for removing the molten aluminum which accumulates there.

11. In the combination of claim 10 wherein said removal means comprises:

a suction tube having an inlet end disposed above said tap end of the cell;

a pierced, titanium diboride member mounted in said inlet end of said suction tube;

said pierced, titanium diboride member having a lowermost extremity at said tap end.

12. In a cell for the electrolytic reduction of alumina wherein said cell comprises a vessel having an external shell and a refractory layer inside said shell, the improvement comprising:

an interior metal lining for said vessel;

said metal lining having a composition consisting essentially of, in wt.%, about:

| | |
|---|---|
| copper | 25-70 |
| nickel | 15-60 |
| iron | 1-30 |

13. In a cell as recited in claim 12 wherein said composition consists essentially of, in wt.%, about:

| | |
|---|---|
| copper | 45-70 |
| nickel | 25-48 |
| iron | 2-17 |

14. In a cell as recited in claim 13 wherein said composition consists essentially of, in wt.%, about:

| | |
|---|---|
| copper | 45-70 |
| nickel | 28-42 |
| iron | 13-17 |

15. In a cell as recited in any of claims 12-14 and comprising:

a plurality of vertically disposed anodes having the same composition as said lining;

and means electrically connecting said interior metal lining to said anodes.

16. In combination, a cell and an electrolyte for the electrolytic reduction of alumina to aluminum, said cell comprising:

a vessel having a bottom and walls extending upwardly from said bottom;

a plurality of non-consumable anodes vertically disposed within said vessel;

and a plurality of dimensionally stable cathodes vertically disposed within said vessel in close, alternating, spaced relation with said vertically disposed cathodes;

said vessel comprising an external shell and an interior metal lining;

each of said anodes having a composition throughout consisting essentially of, in wt.%, about:

| | |
|---|---|
| copper | 25-70 |
| nickel | 15-60 |
| iron | 1-30 |

said electrolyte being contained within said vessel, said electrolyte consisting essentially of 42-26 mol% $AlF_3$ and 54-58 mol% of either (a) NaF or (b) NaF with some of the NaF replaced by an equivalent molar amount of KF or KF and LiF.

17. A cell as recited in claim 16 wherein each of said anodes has a composition consisting essentially of, in wt.%, about:

| | |
|---|---|
| copper | 45-70 |
| nickel | 25-48 |
| iron | 2-17 |

18. A cell as recited in claim 16 wherein each of said anodes has a composition consisting essentially of, in wt.%, about:

| | |
|---|---|
| copper | 45–70 |
| nickel | 28–42 |
| iron | 13–17 |

19. A cell as recited in any of claims 16–18 wherein: each of said anodes is composed of sintered metal powders and has a porous surface.

20. A cell as recited in claim 18 wherein:

each of said anodes has a density substantially less than the theoretical density for said composition.

21. A cell as recited in any of claims 16–18 wherein said interior metal lining has a composition substantially the same as said anodes and has a relatively high density at that part of the lining which is exposed to air.

22. A cell as recited in claim 21 wherein:

said interior metal lining is electrically connected to said anodes.

23. A cell as recited in claim 21 and comprising:

a refractory layer between said external shell and said interior metal lining, for thermally insulating the bottom and the walls of said vessel;

said lining comprising means for protecting said refractory layer from said electrolyte.

24. A cell as recited in claim 16 wherein:

said electrolyte has an $AlF_3$ content of 43–45 mol%.

25. A non-consumable, metallic electrode which is relatively resistant to air oxidation, said electrode comprising:

a relatively imporous surface;

a density of at least about 95% of the theoretical density of the metallic composition of said electrode;

a composition throughout said electrode consisting essentially of:

| | |
|---|---|
| copper | about 70 wt. % max. |
| nickel | greater than about 30 wt. % |
| iron | essentially the balance. |

26. A non-consumable electrode as recited in claim 25 wherein:

said iron content is in the range of about 13–30 wt.%.

27. A non-consumable electrode as recited in claims 25 or 26 wherein:

the weight ratio of nickel to iron is about 3 to 1.

28. In combination, a cell and an electrolyte for the electrolyte reduction of alumina to aluminum, said cell comprising:

a vessel having a bottom and walls extending upwardly from said bottom;

and a plurality of non-consumable anodes vertically disposed within said vessel;

each of said anodes having a composition throughout consisting essentially of, in wt.%, about:

| | |
|---|---|
| copper | 25–70 |
| nickel | 15–60 |
| iron | 1–30 |

said electrolyte being contained within said vessel, said electrolyte consisting essentially of 42–46 mol% $AlF_3$ and 54–58 mol% of either (a) NaF or (b) NaF with some of the NaF replaced by an equivalent molar amount of KF or KF and LiF.

29. In a combination as recited in claim 28 wherein said composition of said non-consumable anode consists essentially of, in wt.%, about:

| | |
|---|---|
| copper | 45–70 |
| nickel | 25–48 |
| iron | 2–17 |

30. In a combination as recited in claim 29 wherein said composition of said non-consumable anode consists essentially of, in wt.%, about:

| | |
|---|---|
| copper | 45–70 |
| nickel | 28–42 |
| iron | 13–17. |

31. An electrolyte as recited in claim 28 wherein:

said $AlF_3$ is in the range 43–45 mol%.

* * * * *

UNITED STATES PATENT AND TRADEMARK OFFICE
CERTIFICATE OF CORRECTION

PATENT NO. : 5,284,562

DATED : February 8, 1994

INVENTOR(S) : Theodore R. Beck, et al.

It is certified that error appears in the above-identified patent and that said Letters Patent is hereby corrected as shown below:

Col. 3, line 60, after "with", add --the--.

Col. 3, line 65, "sinter" should be --sintered--.

In the Claims:

Col. 14, line 56, "42-26" should be --42-46--.

Col. 16, line 8, "electrolyte" should be --electrolytic--.

Signed and Sealed this

Sixteenth Day of August, 1994

*Attest:*

*Attesting Officer*

Bruce Lehman

BRUCE LEHMAN

*Commissioner of Patents and Trademarks*